US009123981B1

(12) United States Patent
Liu et al.

(10) Patent No.: US 9,123,981 B1
(45) Date of Patent: Sep. 1, 2015

(54) TUNABLE RADIO FREQUENCY COUPLER AND MANUFACTURING METHOD THEREOF

(71) Applicant: ADVANCED SEMICONDUCTOR ENGINEERING INC., Kaohsiung (TW)

(72) Inventors: Chien-Yeh Liu, Hsinchu County (TW); Wei-Hsuan Lee, New Taipei (TW); Jaw-Ming Ding, Taoyuan County (TW); Huang-Hua Wen, Changhua County (TW)

(73) Assignee: Advanced Semiconductor Engineering Inc., Kaohsiung (TW)

( * ) Notice: Subject to any disclaimer, the term of this patent is extended or adjusted under 35 U.S.C. 154(b) by 0 days.

(21) Appl. No.: 14/266,070

(22) Filed: Apr. 30, 2014

(30) Foreign Application Priority Data

Feb. 26, 2014 (TW) ..... 103106455 A

(51) Int. Cl.
*H01P 5/04* (2006.01)
*H01P 5/12* (2006.01)
*H01P 3/08* (2006.01)

(52) U.S. Cl.
CPC ... *H01P 5/04* (2013.01); *H01P 5/12* (2013.01)

(58) Field of Classification Search
CPC ..... H01P 5/04; H01P 5/184
USPC ..... 333/24 R, 26, 109, 111, 116
See application file for complete search history.

(56) References Cited

U.S. PATENT DOCUMENTS

| | | | | |
|---|---|---|---|---|
| 4,482,873 | A * | 11/1984 | Nyhus | 333/116 |
| 5,689,217 | A * | 11/1997 | Gu et al. | 333/116 |
| 6,734,757 | B2 * | 5/2004 | Delzer | 333/161 |
| 8,169,275 | B2 * | 5/2012 | Tsai et al. | 333/33 |
| 8,860,191 | B2 * | 10/2014 | Ding et al. | 257/664 |
| 2009/0231059 | A1 | 9/2009 | Peng et al. | |

FOREIGN PATENT DOCUMENTS

| | | |
|---|---|---|
| TW | M343255 | 10/2008 |

* cited by examiner

*Primary Examiner* — Dean Takaoka
(74) *Attorney, Agent, or Firm* — Foley & Lardner LLP; Cliff Z. Liu; Angela D. Murch

(57) ABSTRACT

A tunable radio frequency (RF) coupler and manufacturing method thereof are provided. The tunable RF coupler includes an insulating layer, a first transmission line and a second transmission line. The second transmission line is disposed corresponding to the first transmission line and the insulating layer is disposed between the first transmission line and the second transmission line. The second transmission line includes a plurality of segments separated from each other and arranged along the extension path of the first transmission line. At least one wire is configured to establish an electrical connection between at least two segments, such that the two segments are electrically conductive to each other through the wire.

12 Claims, 8 Drawing Sheets

TUNABLE RADIO FREQUENCY COUPLER AND MANUFACTURING METHOD THEREOF

BACKGROUND OF THE INVENTION

1. Field of the Invention

The present invention relates to a radio frequency (RF) coupler; in particular, to a tunable RF coupler and manufacturing method thereof.

2. Description of Related Art

In recently years, the popularization of the wireless communications product brings more convenience and digitization to people's life. With the increase in the demands of the market and the development of the manufacturing technique, the requirements of the integrated circuit design are changed. Especially in wireless communication field, the circuit designs of receiving port and emitting port would be greatly concerned.

Typically, the front-end module usually includes a RF coupler. A signal through the RF coupler would be received and processed by a back end circuit such as power detector. During the design process of the RF coupler, the appropriate simulations for the band and the coupling of the signal through the RF coupler would be made by the circuit designer, and the circuit layout is determined according to the results of the simulations. Subsequently, after the factory finishes the manufacture of the RF coupler, the RF coupler would be tested by the circuit designer to check whether the characteristics of the RF coupler satisfy the demands of the circuit designer. However, when the characteristics of the RF coupler do not satisfy the demands, for example, the coupling or the desired directivity is not achieved, the circuit designer needs to redesign the circuit layout of the RF coupler, and scrap the RF coupler with poor characteristics, which leads to waste of the resource.

SUMMARY OF THE INVENTION

The present disclosure provides a tunable RF coupler. The tunable RF coupler includes an insulating layer, a first transmission line and a second transmission line. The second transmission line located corresponding to the first transmission line, and the insulating layer is disposed between the first transmission line and the second transmission line. The second transmission line includes a plurality of segments separated from each other and arranged in alignment with an extending path of the first transmission line. At least two of the segments are electrically connected to each other through at least one wire.

According to the embodiment of the present disclosure, a method for manufacturing a tunable RF coupler is provided. The method includes the steps of forming a first transmission line on a first surface of an insulating layer, and forming a second transmission line which includes a plurality of segments separated from each other on a second surface of an insulating layer. The first surface is opposite to the second surface. The segments of the second transmission line are arranged in alignment with the first transmission line. The method further includes the step of placing at least one wire, wherein the at least one wire electrically connects with the at least two segments.

In summary, one of the embodiments of the instant disclosure provides the tunable RF coupler in which the length of the effective transmission portion of the second transmission line can be adjusted based on the electrical connection between at least one wire and a plurality of the segments. As such, the overlapping length between the first transmission line and a projection of the effective transmission portion of the second transmission line is adjustable so as to tune the coupling rate between the first transmission line and the second transmission line. As such, the tunable RF coupler of the instant disclosure may be adaptable to operate in all frequency bands associated with the third generation (3G) mobile communication technology, and make the 3G products have broadband and high directivity.

Furthermore, when the characteristics of the RF coupler do not satisfy the demands, the circuit layout of the RF coupler needs not to be redesigned. By adjusting at least one of the connecting positions between at least one wire and the segments, or changing the connecting way between the wire and the segments, the length of the effective transmission portion of the second transmission line could be adjusted. Accordingly, the tunable RF coupler which has the demanded coupling rate in the desired frequency band (for example, in a higher frequency band or in a lower frequency band) could be designed. It may result in the reduction in the amount of waste RF coupler and the source.

In order to further understand the purpose of the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the present disclosure. As used herein, the term "and/or" includes any and all combinations of one or more of the associated listed items.

[One Embodiment of the Tunable RF Coupler]

Figure 1:
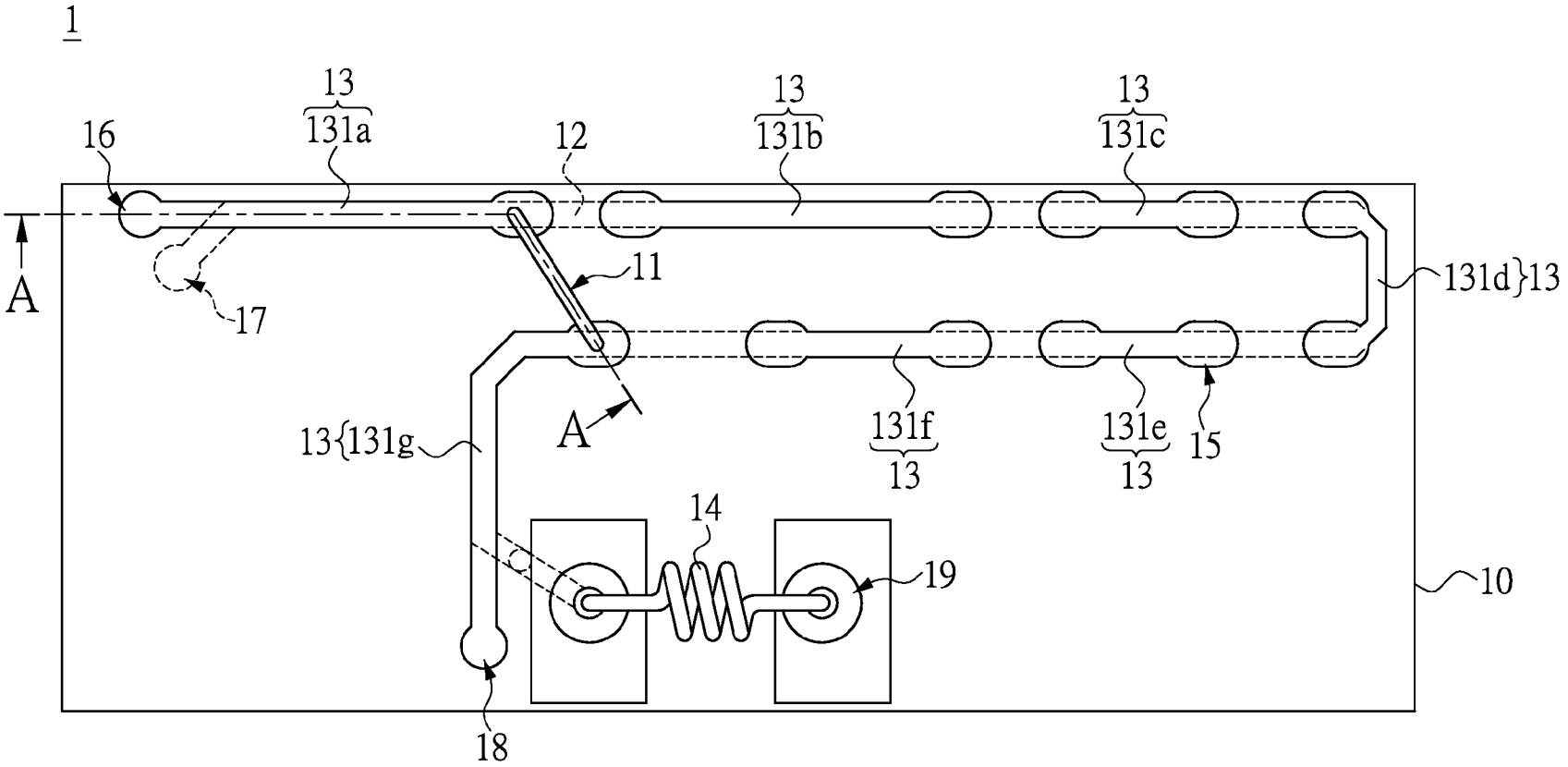
FIG. 1 shows a layout diagram of a tunable RF coupler according to an embodiment of the instant disclosure.
Figure 2:
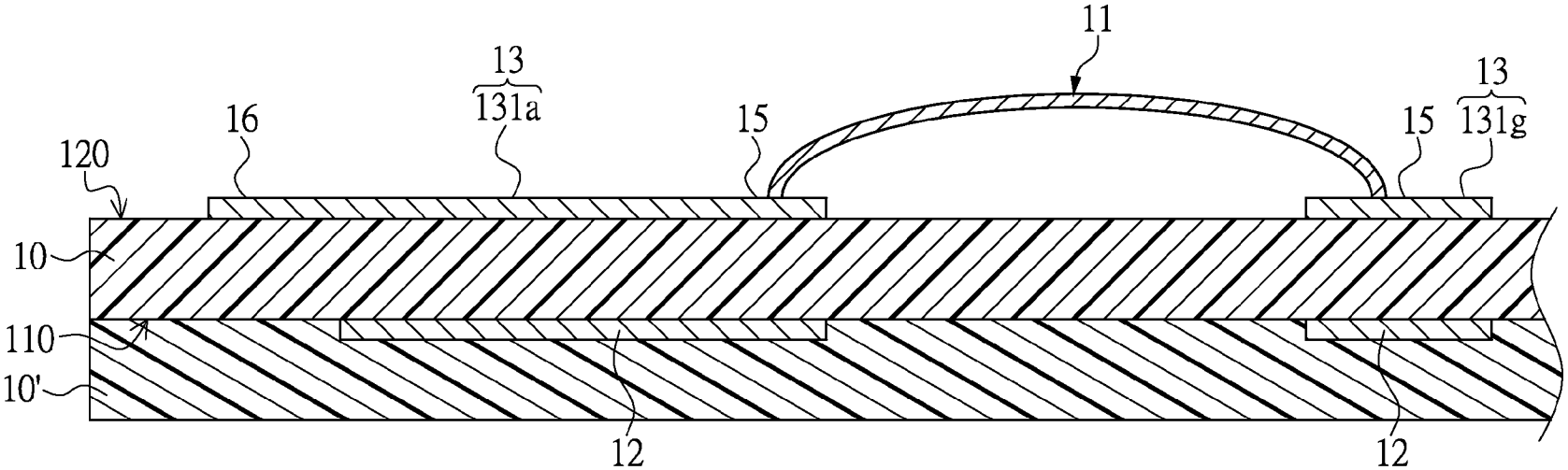
FIG. 2 shows a cross-sectional view of the tunable RF coupler taken along a line A-A in FIG. 1.

Please refer to FIGS. 1 and 2. FIG. 1 shows a layout diagram of a tunable RF coupler according to an embodiment of the instant disclosure, and FIG. 2 shows a cross-sectional view of the tunable RF coupler taken along a line A-A in FIG. 1. The tunable RF coupler 1 has a RF input port 16, a RF output port 18, a coupling port 17, and an isolation port 19. In addition, the tunable RF coupler 1 includes an insulating layer 10, a first transmission line 12, a second transmission line 13, and at least one wire 11. The insulating layer 10 is disposed between the first transmission line 12 and the second transmission line 13. The second transmission line 13 is located corresponding to the first transmission line 12, for example, the second transmission line 13 is disposed directly above the first transmission line 12, and two ends of the second transmission line 13 are respectively connected to the RF input port 16 and the RF output port 18. However, in another embodiment, the arrangements of the second transmission line 13 and the first transmission line 12 could be exchanged. Thus, the arrangements of the first and second transmission lines 12, 13 do not be limited in the instant disclosure. As shown in FIG. 1, the second transmission line 13 includes seven segments 131*a*~131*g* separated from each other and arranged in alignment with an extending path of the first transmission line 12.

Each of the segments 131*a*~131*g* has two ends. One end of the segment 131*a* is electrically connected to the RF input port 16, and one end of the segment 131*g* is electrically connected to the RF output port 18. When the wire 11 is respectively connected to the other two ends of the segments 131*a* and 131*g*, an electrical connection between the RF input port 16 and the RF output port 18 is established through the wire 11, such that the two segments 131*a* and 131*g* form an effective transmission portion of the second transmission line 13, and an coupling rate between the effective transmission portion of the second transmission line 13 and the first transmission line 12 could be generated.

In the instant embodiment, the wire 11 is a bonded wire formed by wire-bonding, and the wire is made of gold (Au). In another embodiment, the wire 11 may be made of aluminum (Al), tin (Sn) or the combination thereof, for example, the wire 11 may be Sn wire for soldering.

In addition, the tunable RF coupler 1 may further include a plurality of finger pads 15. One end of the first segment 131*a* is connected to the RF input port 16, and the other end is connected to one finger pad 15. Moreover, one end of another segment 131*g* is connected to the RF output port 18, and the other end of the segment 131*g* is connected to another finger pad 15. By the connections between the wire 11 and the finger pads 15 which are respectively connected to the segments 131*a* and 131*g*, the segments 131*a* and 131*g* are electrically connected to each other through the wire 11.

Similarly, since the segments 131*a*~131*g* of the second transmission line 13 are separated from each other, and arranged in alignment with the extending path of the first transmission line 12, some of the segments 131*a*~131*g* can be selected to be electrically connected to each other through at least one wire 11 so as to form different effective transmission portions of the second transmission line 13 with different lengths. In addition, an overlapping length of the effective transmission portion of the second transmission line 13 on the first transmission line 12 (substantially equal to the length of the effective transmission portion of the second transmission line 13) is directly proportional to the coupling rate between the first transmission line 12 and the second transmission line 13. By selecting one of the effective transmission portions of the second transmission line 13 having the most appropriate overlapping length, the object for adjusting the coupling rate between the first transmission line 12 and the second transmission line 13 can be achieved.

Furthermore, the effective transmission portion of the second transmission line 13 may be formed by connecting a first segment 131*a*, a second segment 131*b*, a sixth segment 131*f* and a seventh segment 131*g* through a plurality of wires 11. In one word, by selecting different connecting ways between the at least one wire 11 and the segments 131*a*~131*g* of the second transmission line 13, the coupling rate between the first transmission line 12 and the second transmission line 13 can be adjusted, and the broadband in which the tunable RF coupler is adaptable to operate can be changed.

In the instant embodiment of the instant disclosure, the length of the effective transmission portion of the second transmission line 13 does not be limited. In another embodiment, the length of the effective transmission portion of the second transmission line 13 may be designed by one of ordinary skill in the art according to practical requirement.

In addition, in this embodiment, an inductor 14 can be disposed between the first transmission line 12 and the isolation port 19 to increase the impedance and to improve the directivity of the tunable RF coupler 1. In the instant embodiment, the inductor 14 is a lumped element. In another embodiment, one of ordinary skill in the art can design the inductor 14 according to the practical requirements, for example, the inductor 14 may be an embedded inductor, which does not intend to limit the instant disclosure.

Notably, as shown in FIG. 2, the first transmission line 12 and the second transmission line 13 are respectively disposed on two opposite surfaces of the insulating layer 10 such as a first surface 110 and a second surface 120. Specifically, the first transmission line 12 may be disposed on another insulating layer 10' and disposed between the insulating layers 10 and 10'. Simply, the first transmission line 12, the second transmission line 13 and the insulating layer 10 may be a portion of a multilayer circuit board. That is, the tunable RF coupler 1 may be embedded and formed in the multilayer circuit board.

Though the present embodiment takes the seven segments 131*a*~131*g* as an example, the number of the segments in another embodiment may be larger or less than seven, which is determined according to the practical requirements and can be designed by one of ordinary skill in the art. Thus, the instant disclosure does not intend to limit the number of the segments.

In addition, in the instant embodiment, the segment 131*a*~131*g* may respectively have different lengths. However, in another embodiment, the segments 131*a*~131*g* may have the same length.

Furthermore, in the instant embodiment, not all of the seven segments 131*a*~131*g* are straight, some of the segments may be curved, such the fourth segment 131*d* and the seventh segment 131*g*, but in another embodiment, the shapes of the segments are not used to limit the instant disclosure. That is, whether some of the segments may be straight lines or curved lines can be designed by one of ordinary skill in the art according to practical requirements.

Subsequently, in the following description, it takes the tunable RF coupler of the instant embodiment as an example to explain in detail how the RF coupler is used in a higher frequency band and a lower frequency band of 3G.

Figure 3:
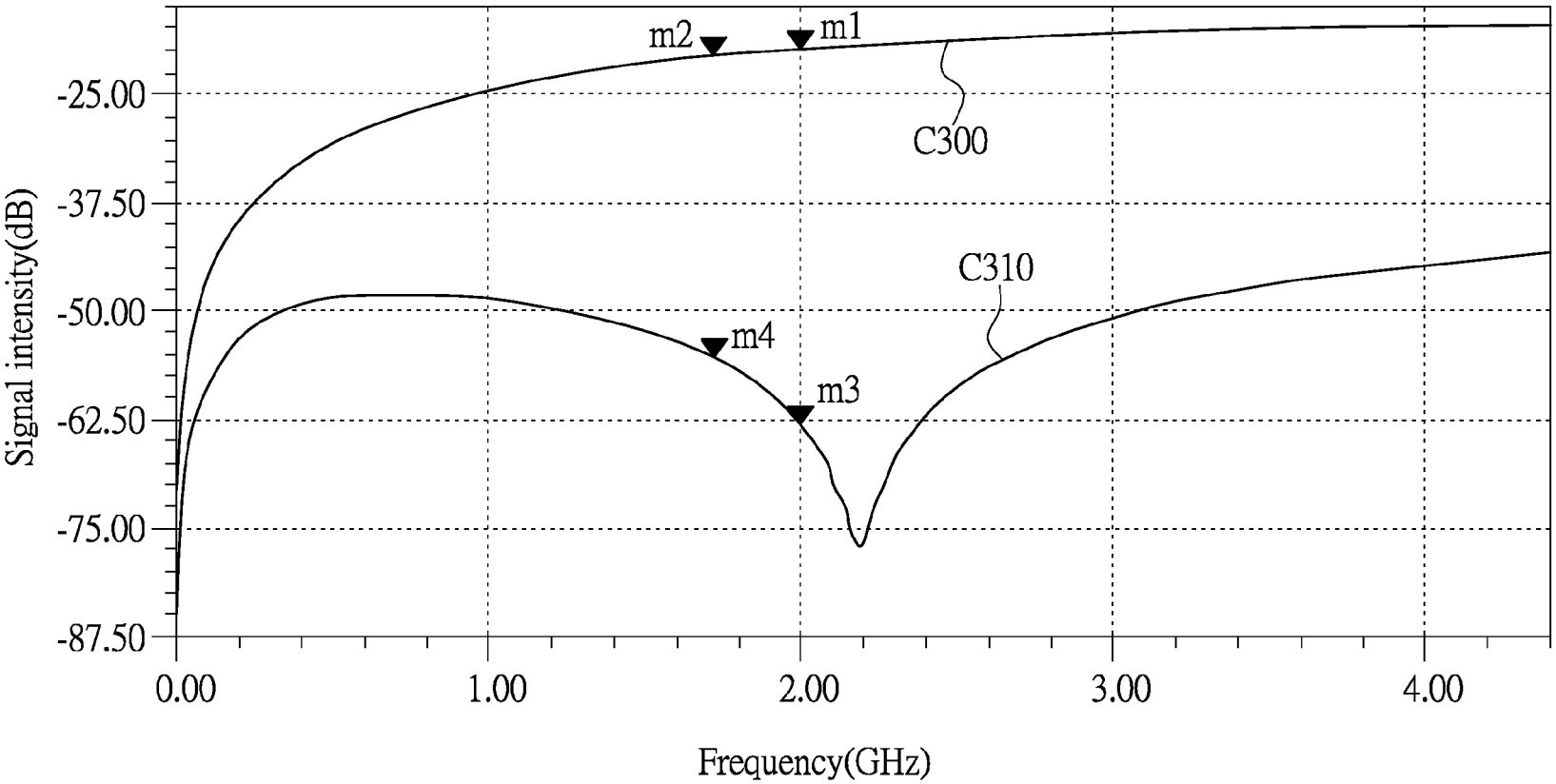
FIG. 3 shows a simulation diagram for the tunable RF coupler shown in FIG. 1.

Specifically, please refer to FIG. 3 and FIG. 1. FIG. 3 shows a simulation diagram for the tunable RF coupler shown in FIG. 1. As illustrated in FIG. 3, the vertical axis shows the signal intensity in dB, while the horizontal axis shows frequency in GHz. Two curves C300 and C310 respectively represent the coupling rate and the isolation of the tunable RF coupler 1. As shown in FIG. 3 and FIG. 1, when the frequency band of 3G in which the tunable RF coupler 1 is used ranges from 1.71 GHz to 1.98 GHz, the length of the effective transmission portion of the second transmission line 13 may be changed to form the shorter one so that the tunable RF coupler 1 is capable of operating at the higher frequency band of 3G ranging from 1.71 GHz to 1.98 GHz.

It can be seen in the FIG. 1 that when the electrical connection between the first segment 131*a* and the seventh segment 131*g* is established through one wire 11, a shorter effective transmission portion of the second transmission line 13 is formed. The effective transmission portion of the second transmission line 13 has a length of 1510 μm, a thickness of 15 μm and a width of 50 μm.

Accordingly, the overlapping length between the first transmission line 12 and the effective transmission portion of the second transmission line 13, which is formed by the first segment 131*a* and the seventh segment 131*g*, is smaller. It can be seen from FIG. 3, when the tunable RF coupler 1 is designed for operation at the higher frequency band of 3G ranging from 1.71 GHz to 1.98 GHz, the coupling rate of the tunable RF coupler 1 has a range (m1~m2) from −22.9 dB to −23.9 dB, and the isolation of the tunable RF coupler 1 has a range (m3~m4) from −64.6 dB to −71.7 dB.

Figure 4:
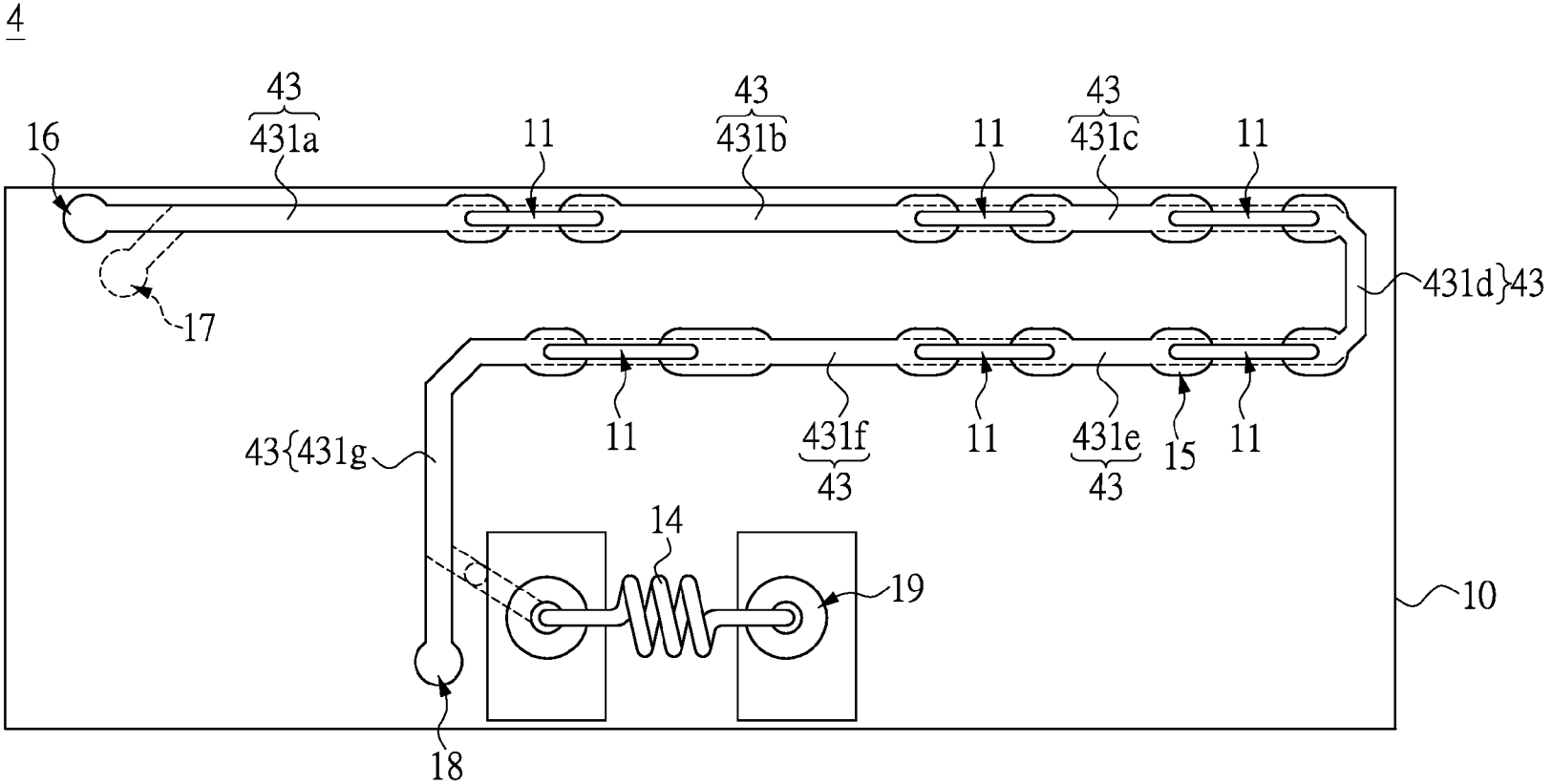
FIG. 4 shows a layout diagram of a tunable RF coupler according to another embodiment of the instant disclosure.
Figure 5:
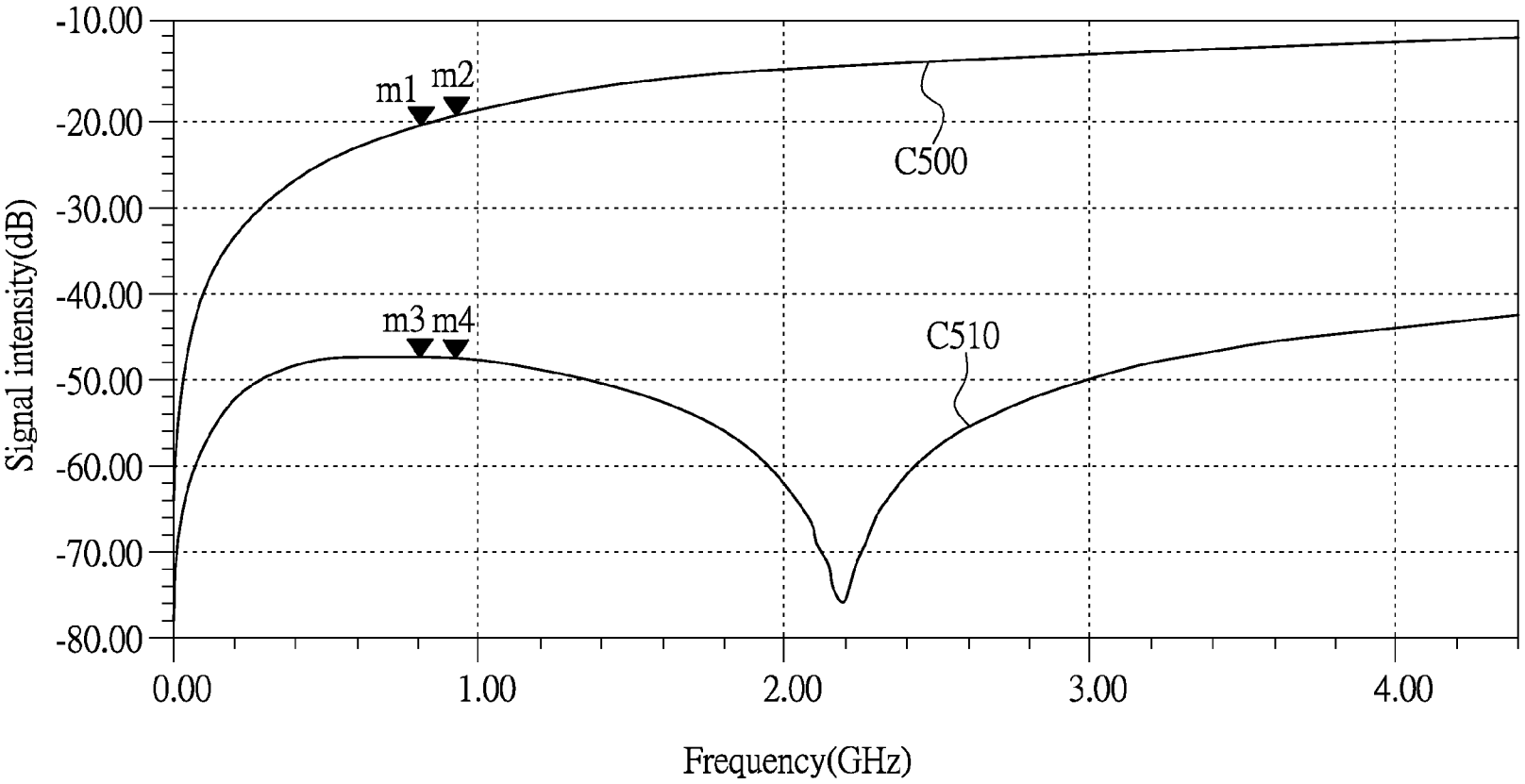
FIG. 5 shows a simulation diagram for the tunable RF coupler shown in FIG. 4.

On the other hand, please refer to FIG. 4 and FIG. 5. FIG. 4 shows a layout diagram of a tunable RF coupler according to another embodiment of the instant disclosure, and FIG. 5 shows a simulation diagram for the tunable RF coupler shown in FIG. 4. As shown in FIG. 4, the tunable RF coupler 4 has similar structure to the tunable RF coupler 1 shown in FIG. 1, and the same reference numerals are given to the same components. The difference between the tunable RF couplers 4 and 1 is in the length of the effective transmission portion of the second transmission line 43, in which the length means the path length of the effective transmission portion of the second transmission line 43. The design of the tunable RF coupler 4 shown in FIG. 4 is suitable for the application in a lower frequency band of 3G ranging from 824 MHz to 915 MHz.

Specifically, in FIG. 5, the vertical axis shows the signal intensity in dB, while the horizontal axis shows frequency in GHz. Two curves C500 and C510 respectively represent the coupling rate and isolation of the tunable RF coupler 4. When the lower frequency band of 3G in which the tunable RF coupler 4 is used ranges from 824 MHz to 915 MHz, an longer effective transmission portion of the second transmission line 43 is formed such that the tunable RF coupler 4 is capable of operating in the lower frequency band of 3G ranging from 824 MHz to 915 MHz.

Specifically, the effective transmission portion of the second transmission line 43 needs longer overlapping length on the first transmission line 12 to satisfy the requirement of operation in the lower frequency band ranging from 824 MHz to 915 MHz. Thus, when the tunable RF coupler 4 is designed for operating in the lower frequency band of 3G ranging from 824 MHz to 915 MHz, all of the adjacent segments 431*a*~431*g* are electrically connected to each other by a plurality of wires 11 to obtain the effective transmission portion of the second transmission line 43 has longer overlapping length on the first transmission line 12, which may make the tunable RF coupler 4 capable of operating at the lower frequency band ranging from 824 MHz~915 MHz.

More specifically, the wires 11 are respectively electrically connected between the first segment 431*a* and the second segment 431*b*, the second segment 431*b* and the third segment 431*c*, the third segment 431*c* and the fourth segment 431*d*, the fourth segment 431*d* and the fifth segment 431*e*, the fifth segment 431*e* and the sixth segment 431*f*, and the sixth segment 431*f* and the seventh segment 431*g*, and the above mentioned effective transmission portion of the second transmission line 43, which satisfies the demands when operating in the lower frequency band ranging from 824 MHz to 915 MHz, may be formed. The effective transmission portion of the second transmission line 43 has a length of 4100 μm, a thickness of 15 μm and a width of 50 μm.

It can be seen that the effective transmission portion of the second transmission line 43 can be formed by connecting all of the segments 431*a*~431*g*, and the tunable RF coupler 4 thus has the coupling rate having a range (m1~m2) from −19.7 dB to −20.6 dB and the isolation having a range (m3~m4) from −47.7 dB to −47.9 dB when the tunable RF coupler 4 is operatively used in the lower frequency band of 3G ranging from 824 MHz to 915 MHz.

Figure 6:
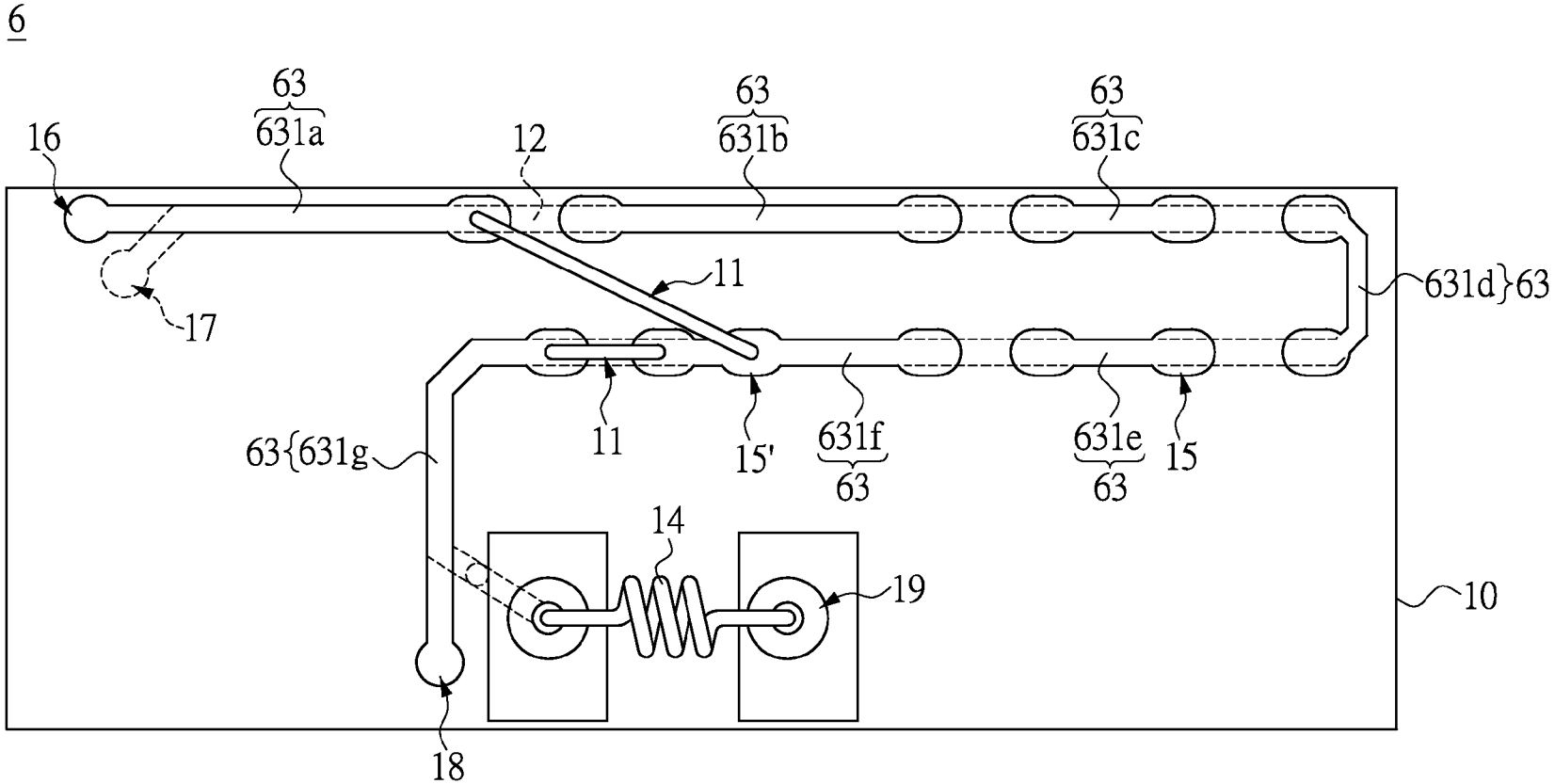
FIG. 6 shows a layout diagram of a tunable RF coupler according to another embodiment of the instant disclosure.
Figure 7:
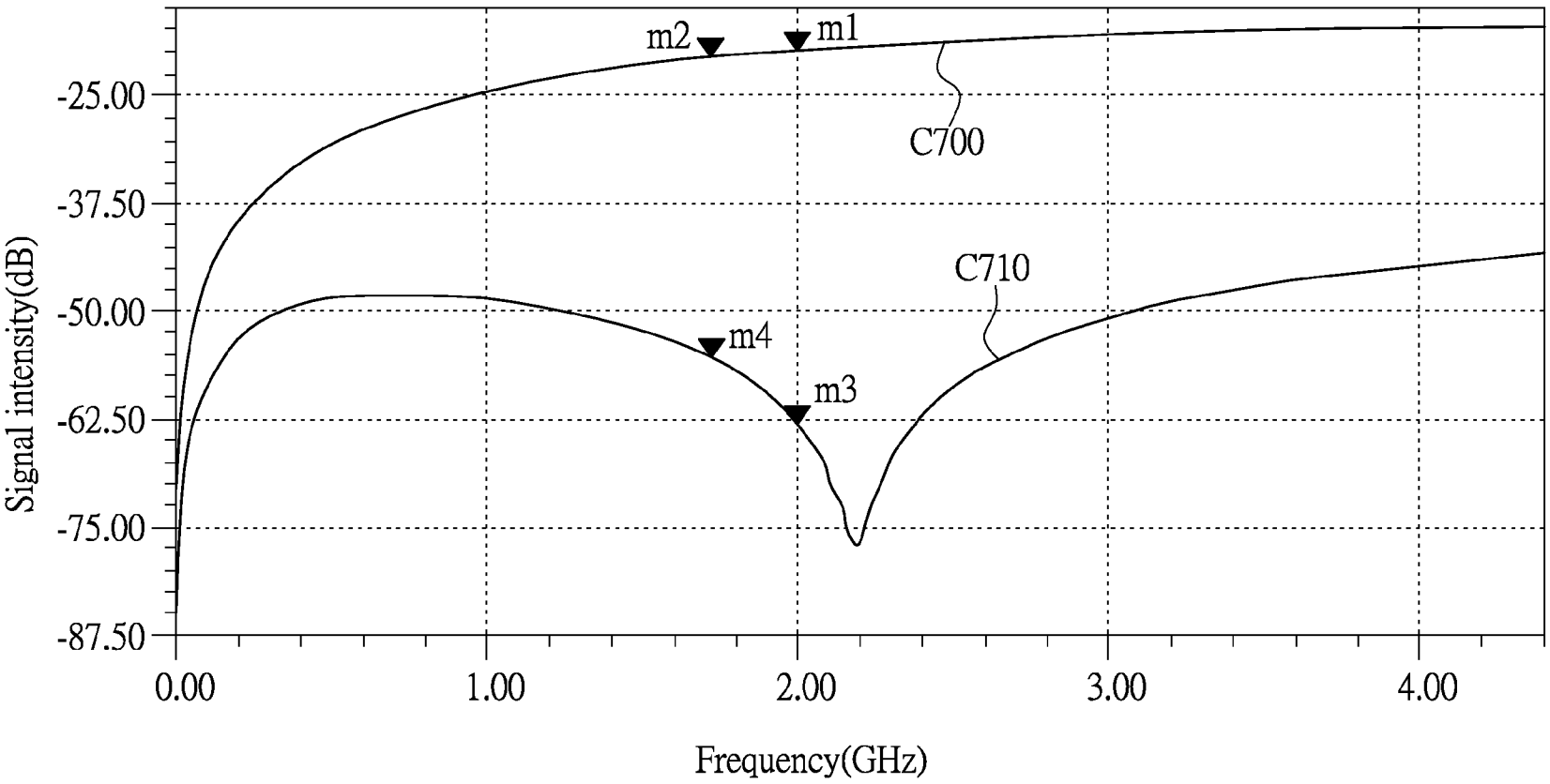
FIG. 7 shows a simulation diagram for the tunable RF coupler shown in FIG. 6.

In addition, please refer to FIG. 6 and FIG. 7. FIG. 6 shows a layout diagram of a tunable RF coupler according to another embodiment of the instant disclosure, and FIG. 7 shows a simulation diagram for the tunable RF coupler shown in FIG. 6. As illustrated in FIG. 6, the tunable RF coupler 6 has a similar structure to that of the tunable RF coupler 1 shown in FIG. 1, and is capable of operating in a higher frequency band of 3G ranging from 1.71 GHz to 1.98 GHz. The same reference numerals are given to the same components or to components corresponding to those in FIG. 1. The difference between the tunable RF couplers 6 and 1 is in the length of the effective transmission portion of the second transmission line 63, in which the length means the path length of the effective transmission portion of the second transmission line 63.

Specifically, as mentioned above, the tunable RF coupler 1, which is shown in FIG. 1 and capable of operating in the higher frequency band of 3G ranging from 1.71 GHz to 1.98 GHz, includes the effective transmission portion of the second transmission line 63. The effective transmission portion of the second transmission line 63 is formed by electrically connecting the first segment 131*a* to the seventh segment 131*g* through the at least one wire 11, and has a length of 1510 μm. In addition, the coupling rate of the tunable RF coupler 1 has a range (m1~m2) from −22.9 dB to −23.9 dB. However, if one hopes that the coupling rate of the tunable RF coupler 1, which is capable of operating in the higher frequency band of 3G ranging from 1.71 GHz to 1.98 GHz, is more approximate to −20 dB at the interval from 1.71 GHz to 1.98 GHz (m1~m2), the length of the effective transmission portion of the second transmission line 63 may be extended through an adjacent finger pad 15' and the other at least one wire 11.

For example, as shown in FIG. 6, the first segment 631*a* is electrically connected to the sixth segment 631*f* through the wire 11. In other words, two ends of the wire 11 are respectively electrically connected to the first segment 631*a* and the sixth segment 631*f*. One end of the wire 11 connected to the sixth segment 631*f* contacts the finger pad 15' which is used for fine tune adjustment. The finger pad 15' is immediately adjacent to the finger pad 15 which is arranged at one end of the sixth segment 631*f*. Another wire 11 is used to make an electrical connection between the seventh segment 631*g* and the sixth segment 631*f*. As a result, an effective transmission portion of the second transmission line 63 having longer length is formed. Accordingly, the effective transmission line has a length of 1700 μm, a thickness of 15 μm and a width of 50 μm.

As shown in FIG. 7, two curves C700 and C710 represent respectively the coupling rate and the isolation of the tunable RF coupler 6. After the effective transmission portion of the second transmission line 63 is fine-tuned, the tunable RF coupler is capable of operating in the higher frequency band of 3G ranging from 1.71 GHz to 1.98 GHz, and the coupling rate has a range (m1~m2) from −19.8 dB to −20.7 dB, while the isolation has a range (m3~m4) from −55.3 dB to −62.3 dB. Accordingly, the coupling rate of the tunable RF coupler 6 corresponding to the frequency band ranging from 1.71 GHz to 1.98 GHz may more approximate to −20 dB so as to meet the requirements of the design.

In summary, as shown in FIG. 1, when the wire 11 is electrically connected between the first segment 131*a* and the seventh segment 131*g* to form an effective transmission portion of the second transmission line 63, the tunable RF coupler 1 is capable of using in the higher frequency band ranging from 1.71 GHz to 1.98 GHz. On the other hand, as shown in FIG. 4, when the electrical connections between the first and second segments 431*a*, 431*b*, the second and third segments 431*b*, 431*c*, the third and fourth segments 431*c*, 431*d*, the fourth and fifth segments 431*d*, 431*e*, the fifth and sixth segments 431*e*, 431*f*, and the sixth and seventh segments 431*f*, 431*g* are established through the wires 11 to form the effective transmission portion of the second transmission line 43, the tunable RF coupler is capable of operating in the lower frequency band ranging from 824 MHz to 915 MHz.

Accordingly, if the tunable RF coupler 1 is operatively used in the higher frequency band ranging from 1.71 GHz to 1.98 GHz, the tunable RF coupler 1 needs the effective transmission portion of the second transmission line 13 having shorter length, such as the length is of 1510 μm. If the tunable RF coupler 4 is operatively used in the lower frequency band ranging from 824 MHz to 915 MHz, the tunable RF coupler 4 needs the effective transmission portion of the second transmission line 43 having longer length, such as the length is of 4100 μm.

In addition, if one needs the coupling rate of the tunable RF coupler 6 falls in the specific range, the wire 11 could be used to connect to the adjacent finger pad 15' and the first segment 631*a* to change the length of the effective transmission portion of the second transmission line 63, as shown in FIG. 6. That is, when the tunable RF coupler 6 needs to satisfy the demands for operation in the higher frequency band ranging from 1.71 GHz to 1.98 GHz and the coupling rate of the tunable RF coupler 6 needs to be more approximate to −20 dB, the length (1500 μm) of the effective transmission portion of the second transmission line 13 of the tunable RF coupler 1 shown in FIG. 1 may be adjusted. The adjusted length (1700 μm) of the effective transmission portion of the second transmission line 63 shown in FIG. 6 may make the coupling rate of the tunable RF coupler 6 more approximate to −20 dB when the tunable RF coupler 6 is operated in the higher frequency band ranging from 1.71 GHz to 1.98 GHz.

In summary, in another embodiment, the wire 11 and the finger pad 15' for fine adjustment may be used to make the effective transmission portion of the second transmission line have various lengths so that the tunable RF coupler could be capable of operating the other bands. In other words, the length of the effective transmission portion of the second transmission line can be designed by one of ordinary skill in the art according to real conditions, and the length of the effective transmission line does not intend to limit the instant disclosure.

Notably, under some real circumstances, the tunable RF coupler 1 without any arrangement of the wire 11 may be delivered to downstream companies. The wires 11 may be arranged on the tunable RF coupler 1 by the downstream companies themselves according to the desired frequency band. Accordingly, it may not be necessary to arrange the wire 11 in the tunable RF coupler 1 before the shipment of the tunable RF coupler 1. The arrangement of the wire 11 can be decided and finished by the user such as the downstream company according to the preferred frequency band so as to adjust the coupling rate between the first transmission line 12 and the second transmission line 13.

[One Embodiment of the Method for Manufacturing the Tunable RF Coupler]

Figure 8:
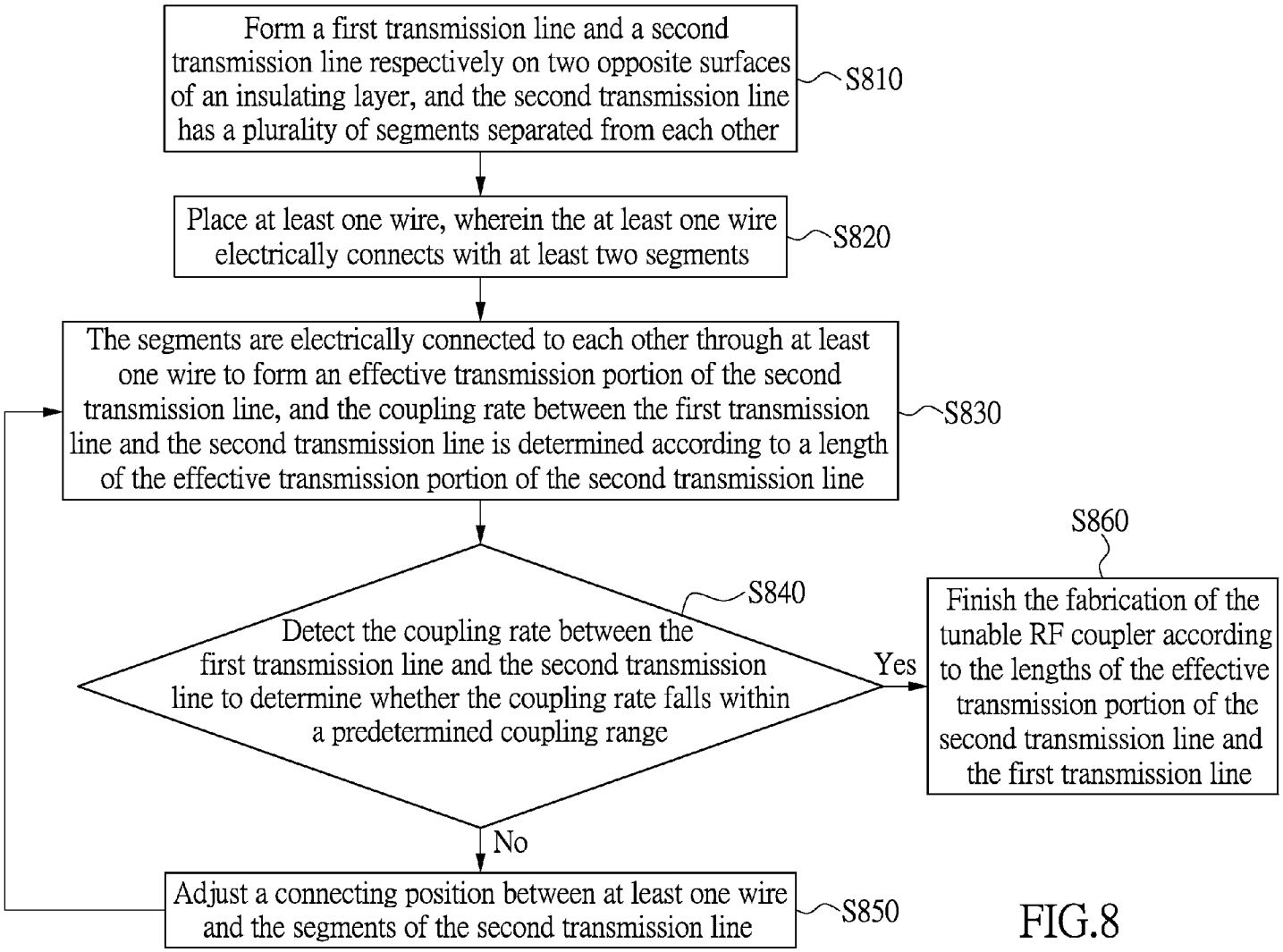
FIG. 8 is a flow chart of a method for manufacturing a tunable RF coupler according to an embodiment of the instant disclosure.

Please refer to FIG. 8 and FIG. 1. FIG. 8 is a flow chart of a method for manufacturing a tunable RF coupler according to an embodiment of the instant disclosure. The method for manufacturing the tunable RF coupler may be applied in the fabrication of the aforementioned tunable RF coupler 1, but does not intend to limit the instant disclosure. The following description of the steps of the method for manufacturing the tunable RF coupler is as follows.

Firstly, in step S810, the first transmission line 12 and the second transmission line 13 are respectively formed on two opposite surfaces of the insulating layer 10. The second transmission line 13 includes a plurality of segments 131*a*~131*g* separated from each other. Subsequently, in step S820, at least one wire 11 is placed to establish an electrical connection between at least two segments. Subsequently in step S830, the segments are electrically connected to each other through the at least one wire 11 to form an effective transmission portion of the second transmission line 13, and a coupling rate between the first transmission line 12 and the second transmission line 13 is determined according to a length of the effective transmission portion of the second transmission line 13. In step S840, a coupling rate between the first transmission line 12 and the effective transmission portion of the second transmission line 13 is detected to determine whether the coupling rate between the first transmission line 12 and the second transmission line 13 falls within a predetermined coupling range. In step S850, when the coupling rate between the first transmission line 12 and the second transmission line 13 falls out of the predetermined coupling range, a connecting position between the at least one wire 11 and the segments 131*a*~131*g* of the second transmission line 13 may be adjusted. In step S860, when the coupling rate between the first transmission line 12 and the second transmission line 13 falls within the predetermined coupling range, the tunable RF coupler is fabricated according to the lengths of the effective transmission portion of the second transmission line 13 and the first transmission line 12. Each of the steps will be subsequently described in the following description for further understanding the content of the instant disclosure.

Specifically, in step S810, please refer to FIG. 1 and FIG. 2. The first transmission line 12 is formed on the first surface 110 of the insulating layer 10, and two ends of the first transmission line 12 are respectively electrically connected to the coupling port 17 and the isolation port 19. In addition, the second transmission line 13 is formed on the second surface 120, which is opposite to the first surface 110, of the insulating layer 10, and the second transmission line 13 includes a plurality of the segments 131*a*~131*g* separated from each other. For example, the second transmission line 13 is directly disposed above the first transmission line 12 and arranged in alignment with the extending path of the first transmission line 12. Moreover, one end of the second transmission line 13 is electrically connected to the RF input port 16, and another end of the second transmission line 13 is electrically connected to the RF output port 18. Specifically, the tunable RF coupler 1 further includes a plurality of the finger pads, and each of the segments 131*a*~131*g* has two ends. One end of the segment 131*a* is electrically connected to the RF input port 16, while the other end of the segment 131*a* is connected to the finger pad 15. In addition, one end of the segment 131*g* is electrically connected to the RF output port 18, while the other end of the segment 131*g* is connected to the finger pad 15. Also, the two ends of each of the other segments 131*b*~131*f* are respectively connected to the finger pads 15.

Furthermore, in step S820, the wire 11 is placed to connect the two segments 131*a* and 131*g* so that the RF input port 16 is electrically connected to the RF output port 18 through the wire 11. In short, by the connections between the wire 11 and the finger pads 15, the segment 131*a* is electrically connected to the segment 131*g* through the wire 11.

Furthermore, in step S830, by placing the wire 11 to connect the two segments 131*a* and 131*g*, the segments 131*a* and 131*g* become an effective transmission portion of the second transmission line 13. The length of the effective transmission portion of the second transmission line 13 formed by the segments 131*a* and 131*g* determines the coupling rate between the first transmission line 12 and the second transmission line 13.

Furthermore, in step S840, an input signal is provided to the RF input port 16, and a coupling signal is generated on the coupling port 17. It can be determined whether the coupling rate between the second transmission line 13, which includes the segments 131*a* and 131*g*, and the first transmission line 12 falls within the predetermined coupling range by detecting the coupling signal. In step S840, if so, proceed to the step S860; if not, proceed to step S850.

Furthermore, in step S850, when the coupling rate between the first transmission line 12 and the second transmission line 13 falls out of the predetermined coupling range, a connecting position between the wire 11 and the segments of the second transmission line 13 is adjusted. Specifically, the length of the effective transmission portion of second transmission line 13 can be finely adjusted by connecting the wire 11 to the adjacent finger pad 15' so that the coupling rate between the first transmission line 12 and the second transmission line 13 can fall within the predetermined coupling range.

For example, it can be seen in FIG. 1 and FIG. 3 that the coupling rate between the first transmission line 12 and the second transmission line 13 ranges from −22.9 dB to −23.9 dB. The effective transmission portion of the second transmission line 13 includes the first segment 131*a* and the seventh segment 131*g* electrically connected to each other through the wire 11 and for example has a length of 1510 μm. The coupling rate ranging from −22.9 dB to −23.9 dB falls out of the predetermined coupling range such as −20 dB. Accordingly, the coupling rate between the second transmission line 13 and the first transmission line 12 can be adjusted by changing the connecting position between the wire 11 and the segments. As shown in FIG. 6, two ends of the wire 11 are respectively connected to the first segment 631*a* and the sixth segment 631*f*. While the wire 11 is connected to the sixth segment 631*f*, one of the ends of the wire 11 is connected to the finger pad 15' immediately adjacent to the finger pad 15 for fine adjustment. In addition, an another wire 11 is used to establish an electrical connection between the sixth segment 631*f* and the seventh segment 631*g*, and an effective transmission line having the longer length (such as of 1700 μm) is formed. Accordingly, as shown in FIG. 7, after fine adjustment, the coupling rate between the first transmission line 12 and the second transmission line 13 ranges from −19.8 dB to −20.7 dB to meet the requirements of design.

Furthermore, in step S860, when the coupling rate between the first transmission line 12 and the second transmission line 13 falls within the predetermined coupling range (for example −20 dB), the fabrication of the tunable RF coupler 1 is made according to the lengths of the effective transmission portion of the second transmission line 13 and the first transmission line 12.

[The Effect of the Instant Disclosure]

To sum up, one of the embodiments of the instant disclosure provides the tunable RF coupler having the effective transmission portion of the second transmission line which can be formed by establishing different electrical connections between at least one wire and a plurality of the segments, and thus the length of the effective transmission portion of the second transmission line can be adjusted. As such, the overlapping length between the first transmission line and a projection of the effective transmission portion of the second transmission line is adjustable so as to tune the coupling rate between the first transmission line and the second transmission line. As such, the tunable RF coupler of the instant disclosure may be adaptable to operate in all frequency bands associated to 3G technology, and make the 3G products have broadband and high directivity. Furthermore, it may result in the reduction in the amount of waste RF coupler and the source.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A tunable radio frequency (RF) coupler comprising:

an insulating layer;

a first transmission line; and a second transmission line located corresponding to said first transmission line, wherein said insulating layer is disposed between said first transmission line and said second transmission line, and said second transmission line comprises:

a plurality of segments separated from each other and arranged in alignment with an extending path of said first transmission line, wherein at least two of said segments are electrically connected to each other through at least one wire.

2. The tunable RF coupler according to claim 1, wherein said second transmission line has two ends, one end of said second transmission line is electrically connected to a RF input port, and another end of said second transmission line is electrically connected to a RF output port.

3. The tunable RF coupler according to claim 1, wherein said at least one wire is electrically connected to said segments so as to adjust a coupling rate between said first transmission line and said second transmission line.

4. The tunable RF coupler according to claim 3, wherein said segments are electrically connected to each other through said at least one wire to form an effective transmission portion of said second transmission line, and said coupling rate between said first transmission line and said second transmission line is determined according to a length of said effective transmission portion of said second transmission line.

5. The tunable RF coupler according to claim 1, further comprising an inductor, wherein said inductor is electrically connected between said first transmission line and an isolation port.

6. The tunable RF coupler according to claim 1, further comprising a plurality of finger pads, wherein at least one end of each of said segments is connected to said finger pad, and said at least one wire is connected to said finger pads.

7. A method for manufacturing a tunable RF coupler comprising:

forming a first transmission line and a second transmission line on two opposite surfaces of an insulating layer, wherein said second transmission line includes a plurality of segments separated from each other; and placing at least one wire, wherein said at least one wire electrically connects with said at least two segments.

8. The method for manufacturing the tunable RF coupler according to claim 7, wherein said segments are electrically connected to each other through said at least one wire to form an effective transmission portion of said second transmission line, and a coupling rate between said first transmission line and said second transmission line is determined according to a length of said effective transmission portion of said second transmission line.

9. The method for manufacturing the tunable RF coupler according to claim 8, further comprising:

detecting a coupling rate between said first transmission line and said second transmission line; and adjusting a connecting position between said at least one wire and said segments of said second transmission line when said coupling rate between said first transmission line and said second transmission line falls out of a predetermined coupling range.

10. The method for manufacturing the tunable RF coupler according to claim 9, wherein one end of said second transmission line is electrically connected a RF input port, and another one end of said second transmission line is electrically connected a RF output port, and the step for detecting said coupling rate between said first transmission line and said second transmission line comprises:

providing an input signal to said RF input port to generate a coupling signal on a coupling port; and detecting said coupling rate between said first transmission line and said second transmission line according to said coupling signal.

11. The method for manufacturing the tunable RF coupler according to claim 7, further comprising:

disposing an inductor on said insulating layer, wherein said inductor is electrically connected between said first transmission line and an isolation port, and said inductor is corresponding to said second transmission line.

12. The method for manufacturing the tunable RF coupler according to claim 7, further comprising:

disposing a plurality of finger pads on said insulating layer, wherein at least one end of each of said segments is connected to said finger pad, and two ends of said at least one wire are respectively connected to said finger pads.

* * * * *